United States Patent [19]

Dixon

[11] Patent Number: 4,523,511

[45] Date of Patent: Jun. 18, 1985

[54] RECIPROCATING FLUID-OPERATED ACTUATOR WITH DECELERATION CONTROL

[75] Inventor: Paul H. Dixon, Belvidere, Ill.

[73] Assignee: Dixon Automatic Tool, Inc., Rockford, Ill.

[21] Appl. No.: 581,241

[22] Filed: Feb. 17, 1984

[51] Int. Cl.[3] ..... F15B 15/22

[52] U.S. Cl. ..... 91/24; 91/405

[58] Field of Search ..... 91/405, 404, 406, 26, 91/24

[56] References Cited

U.S. PATENT DOCUMENTS 2,922,439 1/1960 Palmer ..... 91/405

3,054,383 9/1962 Hanna ..... 91/24

FOREIGN PATENT DOCUMENTS 630730 11/1961 Canada ..... 91/405

913891 12/1962 United Kingdom ..... 91/405

OTHER PUBLICATIONS

Table of Contents (one page) of a brochure coprighted in 1969 by Flick Reedy Corporation.

*Primary Examiner*—Paul E. Maslousky

*Attorney, Agent, or Firm*—Leydig, Voit, Osann, Mayer & Holdt, Ltd.

[57] ABSTRACT

Valves are located at opposite ends of a cylinder and are automatically moved toward closed positions at a controlled rate as a piston approaches the ends of the cylinder. Upon being moved toward its closed position, each valve restricts the flow of exhaust air from the respective end of the cylinder and causes the piston to decelerate so as to cushion the piston as it comes to a stop.

7 Claims, 8 Drawing Figures

RECIPROCATING FLUID-OPERATED ACTUATOR WITH DECELERATION CONTROL

BACKGROUND OF THE INVENTION

This invention relates to a reciprocating actuator and, more particularly, to a fluid-operated actuator of the type in which a piston member is telescoped into a cylinder member. When pressure fluid is exhausted from one end of the cylinder member, one of the members moves in one direction relative to the other member.

The actuator of the invention preferably is of the double-acting type in which the piston is moved first in one direction and then the other as pressure fluid is alternately admitted into and exhausted from opposite ends of the cylinder. In some actuators of this type, provision is made to cushion the impact of the piston against the ends of the cylinder by causing the piston to decelerate as it approaches the ends of its stroke. In most cushioned actuators, the deceleration occurs abruptly and in itself imparts shock to the actuator and to the mechanism or mechanisms operated by the actuator.

SUMMARY OF THE INVENTION

The general aim of the present invention is to provide a new and improved cushioned actuator in which the deceleration occurs smoothly and at a rate which can be precisely controlled.

A more detailed object is to achieve the foregoing by equipping the actuator with unique valves which respond to the position of the piston in the cylinder and which restrict the exhaust of pressure fluid from the cylinder at a controlled rate so as to effect smooth deceleration as the actuator approaches the ends of its strokes.

Another object is to provide valves which may be easily adjusted to regulate both the steady state speed of the actuator and the point at which deceleration occurs during the final portion of the stroke.

DETAILED DESCRIPTION OF THE PREFERRED EMBODIMENT

Figures 1, 2:
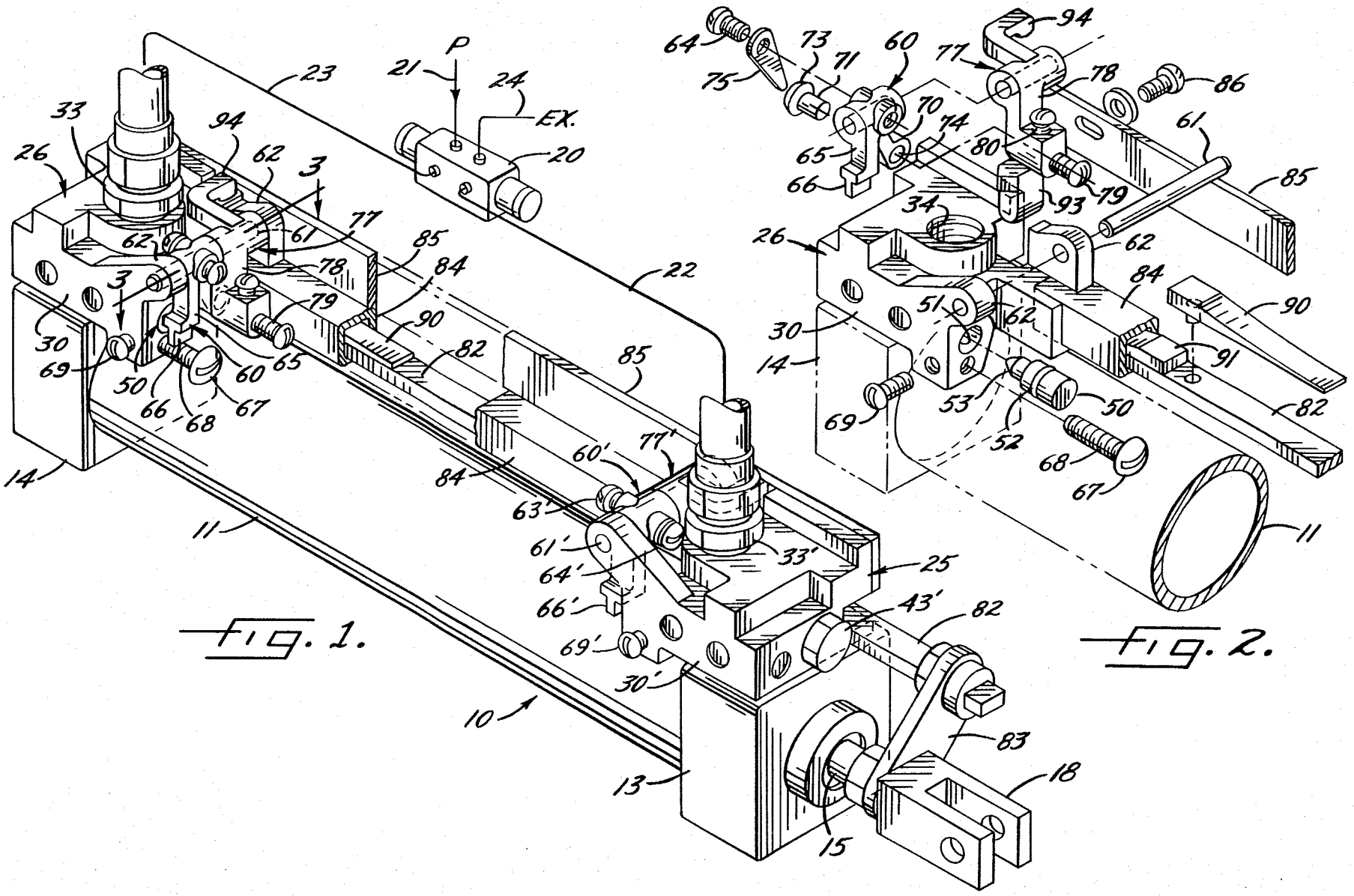
FIG. 1 is a perspective view of a new and improved fluid-operated actuator incorporating the unique features of the present invention.
FIG. 2 is an exploded perspective view of certain parts of the actuator shown in FIG. 1.
Figure 3:
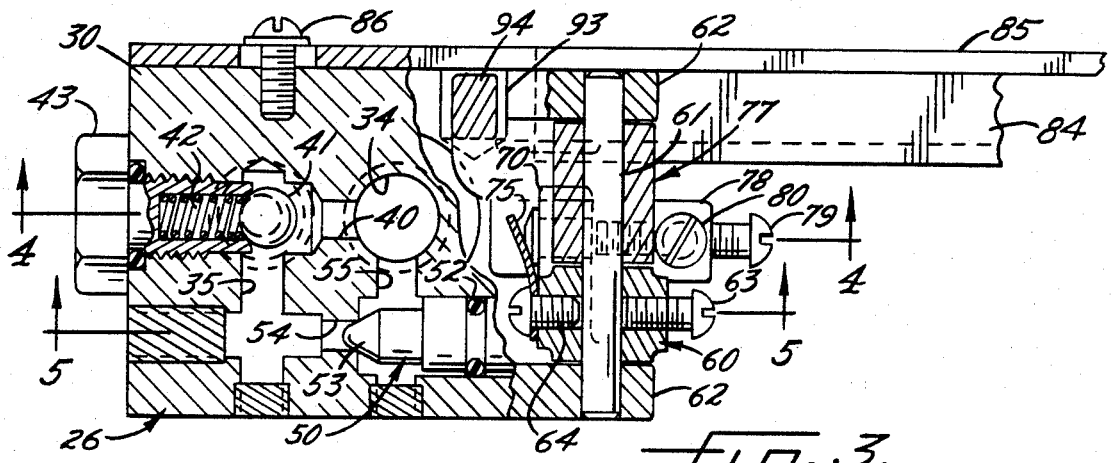
FIG. 3 is an enlarged fragmentary cross-section taken substantially along the line 3—3 of FIG. 1.

As shown in the drawings for purposes of illustration, the invention is embodied in a reciprocating fluid-operated actuator 10 having an elongated cylinder 11 and having a piston 12 (FIG. 6) telescoped slidably in the cylinder. In this particular instance, the piston is adapted to be reciprocated back and forth in the cylinder although it will be appreciated that the piston could be held in a stationary position and that the cylinder could be reciprocated back and forth along the piston.

The front and rear ends of the cylinder 11 are closed by front and rear end caps 13 and 14, respectively. An elongated rod 15 is attached to the forward end of the piston 12 and extends slidably through the front end cap 13, there being a seal 16 (FIG. 6) between the rod and the front end cap. A clevis 18 is attached to the free end of the rod and may be connected to any mechanism or device adapted to be operated by the actuator. The actuator may, for example, be connected to reciprocate power-operated screwdriver of the type disclosed in Dixon U.S. Pat. No. 3,675,302.

When pressurized air is admitted into the rear end of the cylinder 11 and is exhausted from the forward end of the cylinder, the piston 12 and the rod 15 are advanced in a forward direction. Conversely, the piston and the rod are retracted rearwardly when pressurized air is admitted into the forward end of the cylinder and is exhausted from the rear end of the cylinder. The flow of air into and out of the two ends of the cylinder is controlled by a conventional four-way valve 20 (FIG. 1) connected to a pressure source by a line 21, connected to the forward and rear ends of the cylinder by lines 22 and 23, respectively, and having an exhaust line 24 leading to atmosphere. The valve may be shifted either manually or automatically in a well-known manner to cause opposite ends of the cylinder to be alternately pressurized.

When the piston 12 reaches the ends of its stroke, it will impact abruptly against the end caps 13 and 14 of the cylinder 11 unless provision is made to reduce the speed of the piston before it strikes the end caps. In some existing actuators, reduced diameter portions on the ends of the piston telescope into chambers in the end caps as the piston approaches the ends of its stroke. Such telescoping compresses the air in the chambers and causes the piston to decelerate. While this cushions the impact of the piston against the end caps, the deceleration itself occurs rather abruptly and imparts shock to the actuator. In addition, the deceleration characteristics usually are fixed and usually cannot be adjusted to meet different requirements.

In accordance with the present invention, the actuator 10 is equipped with unique valves 25 and 26 which respond to the position of the piston 12 and which restrict the exhaust of air from the ends of the cylinder 11 as the piston approaches the ends of its stroke. Because the flow of exhaust air is restricted by the valves, the piston decelerates and thus is cushioned as it reaches the ends of its stroke. The valves restrict the flow of exhaust air at a controlled rate and thus the deceleration occurs gradually and smoothly. Moreover, the valves may be easily adjusted to change both the steady state speed and the point of deceleration of the piston.

More specifically, the valves 25 and 26 are mounted on the end caps 13 and 14, respectively. The valves are substantially identical and thus only the construction of the rear valve 26 will be described in detail.

Figure 4:
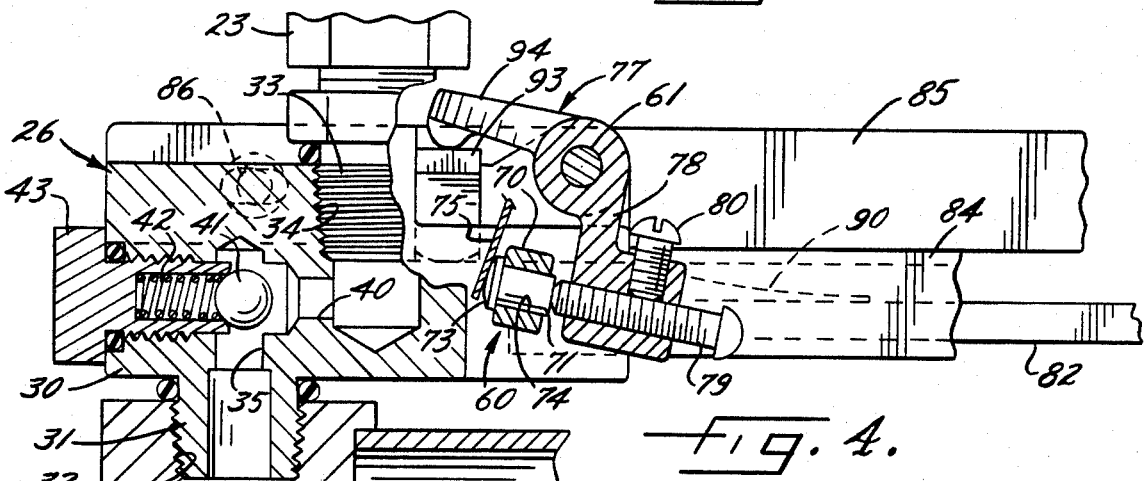
FIGS. 4 and 5 are fragmentary cross-sections taken substantially along the lines 4—4 and 5—5, respectively, of FIG. 3.
Figure 5:
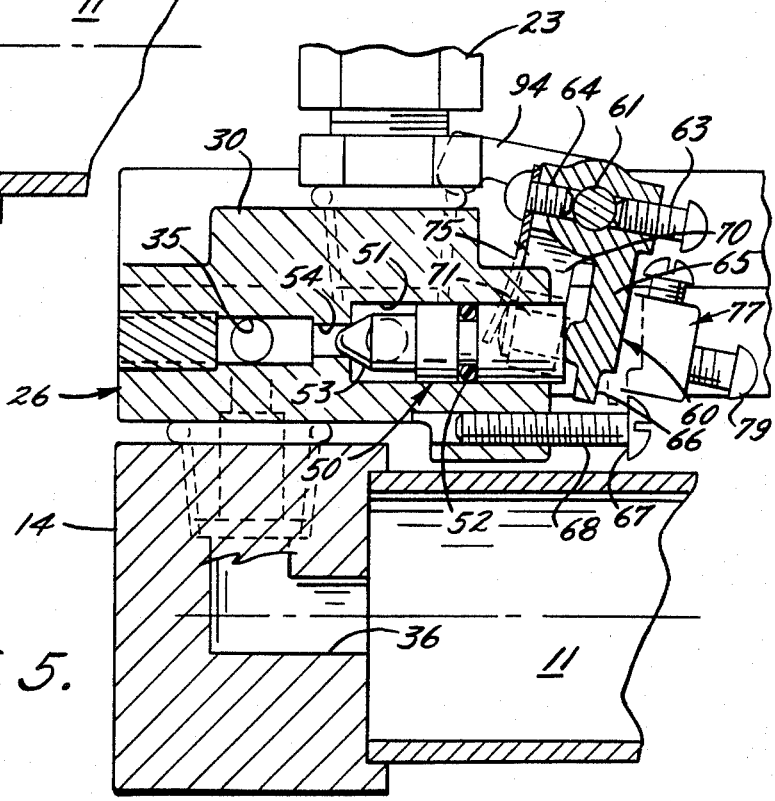

As shown most clearly in FIG. 4, the rear valve 26 comprises a housing 30 whose lower side carries a fitting 31 which is threaded into a bore 32 in the rear end cap 14. A fitting 33 is threaded into a bore 34 in the upper side of the valve housing 30 and is connected to the line 23. The ports defined by the fittings 31 and 33 are adapted to communicate with one another by means of a passage 35 (FIGS. 4 and 6) formed in the housing 30 and extending between the fittings. The passage 35 communicates with the rear end of the cylinder 11 by way of a passage 36 formed in the end cap 14.

The valve 26 is constructed so as to permit pressurized air to flow from the line 23 and the port 33 to the rear end of the cylinder 11 via the passages 35 and 36. The valve, however, prevents exhaust air from flowing out of the rear end of the cylinder and to the port 33 and the line 23 by way of the upper portion of the passage 35. For this purpose, the upper portion of the passage 35 communicates with the port 33 by means of a branch passage 40 (FIGS. 4 and 6) in the housing. A check valve in the form of a ball 41 is disposed in the passage 40 and is biased toward a frustoconical seat by a coiled compression spring 42 telescoped into a tubular plug 43 which is threaded into the housing 30. When the line 23 is pressurized, the pressure pops the ball 41 away from the seat to allow air to flow to the passage 35 and the cylinder 11 via the branch passage 40. When the pressure in the line 23 is dumped, the spring 42 forces the ball 41 against the seat to close off the branch passage 40 and prevent exhaust air in the rear end of the cylinder 11 from flowing to the line 23 by way of the upper portion of the passage 35.

In carry out the invention, the flow of exhaust air from the rear end of the cylinder 11 is controlled by a valve member 50 (FIG. 3 and FIGS. 5 to 7). The valve member 50 herein is in the form of a plunger which is slidably received in a bore 51 in the valve housing 30, there being a sealing ring 52 between the plunger and the wall of the bore. The inner end of the plunger 50 is formed with a needle-like stem 53 adapted to project into a branch passage 54 communicating with the passage 35 and with an additional passage 55 formed in the housing 30 and communicating with the port 33. When the stem 53 of the valve member 50 is seated fully in the branch passage 54, exhaust air from the rear end of the cylinder 11 is prevented from flowing to the port 33 and the line 23 via the passage 35, the branch passage 54 and the passage 55. When the valve member 50 opens, however, by moving to the right, the stem 53 meters such exhaust air out of the cylinder and to the line 23 at a controlled rate determined by the open position of the valve member.

Pursuant to the invention, means are provided for moving the valve member 50 toward its closed position as the piston 12 approaches the end of its rearward stroke. As the valve member moves toward its closed position and chokes off the branch passage 54, the flow of exhaust air from the rear end of the cylinder 11 is restricted. As a result, the air in the rear end of the cylinder is compressed to cause the piston to decelerate and to cushion the piston as it approaches the end cap 14.

In the present instance, the aforementioned means comprise a lever-like member 60 mounted on a horizontal pin 61 which is rotatably supported by a pair of spaced ears 62 on the valve housing 30. The lever 60 is secured to the pin 61 by a pair of set screws 63 and 64 which cause the lever and the pin to turn as a unit.

The lever 60 is formed with a depending arm 65 which extends downwardly alongside the outer end of the valve member 50. When the lever is rocked in a clockwise direction, the arm engages the outer end of the valve member and pushes the valve member inwardly toward its closed position. When the lever 60 is rocked counterclockwise, the valve member 50 is permitted to slide outwardly until a finger 66 on the lower end of the arm 65 stops against the head 67 of a screw 68 threaded into the valve housing 30. The screw 68 is locked against turning by a set screw 69 threaded into the housing.

As shown most clearly in FIG. 2, the lever 60 also includes a second depending arm 70 which extends downwardly at an angle relative to the arm 65. A pin 71 (FIG. 4) having a head 73 extends slidably through a hole 74 in the arm 70, the head being located on the inner side of the arm. For a purpose to be explained subsequently, a cantilevered leaf spring 75 is fastened at its upper end to the lever 60 by the screw 64. The lower end portion of the leaf spring 75 bears against the head 73 of the pin 71 and urges the pin outwardly. The spring is relatively stiff and normally presses the head of the pin against the inner side of the arm 70 (see FIG. 4).

Importantly, a lever or bellcrank 77 is mounted on the pin 61 alongside the lever 60 and is free to rock back and forth on the pin. The bellcrank includes a depending arm 78 (FIG. 4) which extends downwardly along the outer side of the arm 70 of the lever 60. A screw 79 is threaded into and extends through the lower end portion of the arm 78 and is adapted to engage the outer end of the pin 71. The screw 79 normally is locked in a fixed position relative to the arm 78 by a set screw 80 which is threaded into the arm.

When the bellcrank 77 of the rear valve 26 is rocked in a clockwise direction, the inner end of the screw 79 engages the outer end of the pin 71. The spring 75 normally prevents the pin 71 from sliding inwardly relative to the arm 65 and thus the screw 79 acts through the pin 71 to rock the lever 60 clockwise. As a result, the finger 66 of the lever 60 engages the valve member 50 to shift the latter toward its closed position.

In keeping with the invention, the bellcrank 77 is rocked in a direction to close the valve member 50 as the piston 12 approaches the end of its rearward stroke. For this purpose, the forward end of a bar 82 (FIGS. 1 and 2) is attached rigidly to the forward end of the rod 15 by a bracket 83 so as to cause the bar to move back and forth in unison with the rod 15 and the piston 12. The bar is supported for back and forth sliding by an elongated guide tube 84 which extends between the valves 25 and 26. An upright mounting strip 85 is secured rigidly to the guide tube 84 and is fastened to the valves by screws 86.

Figures 6, 7:
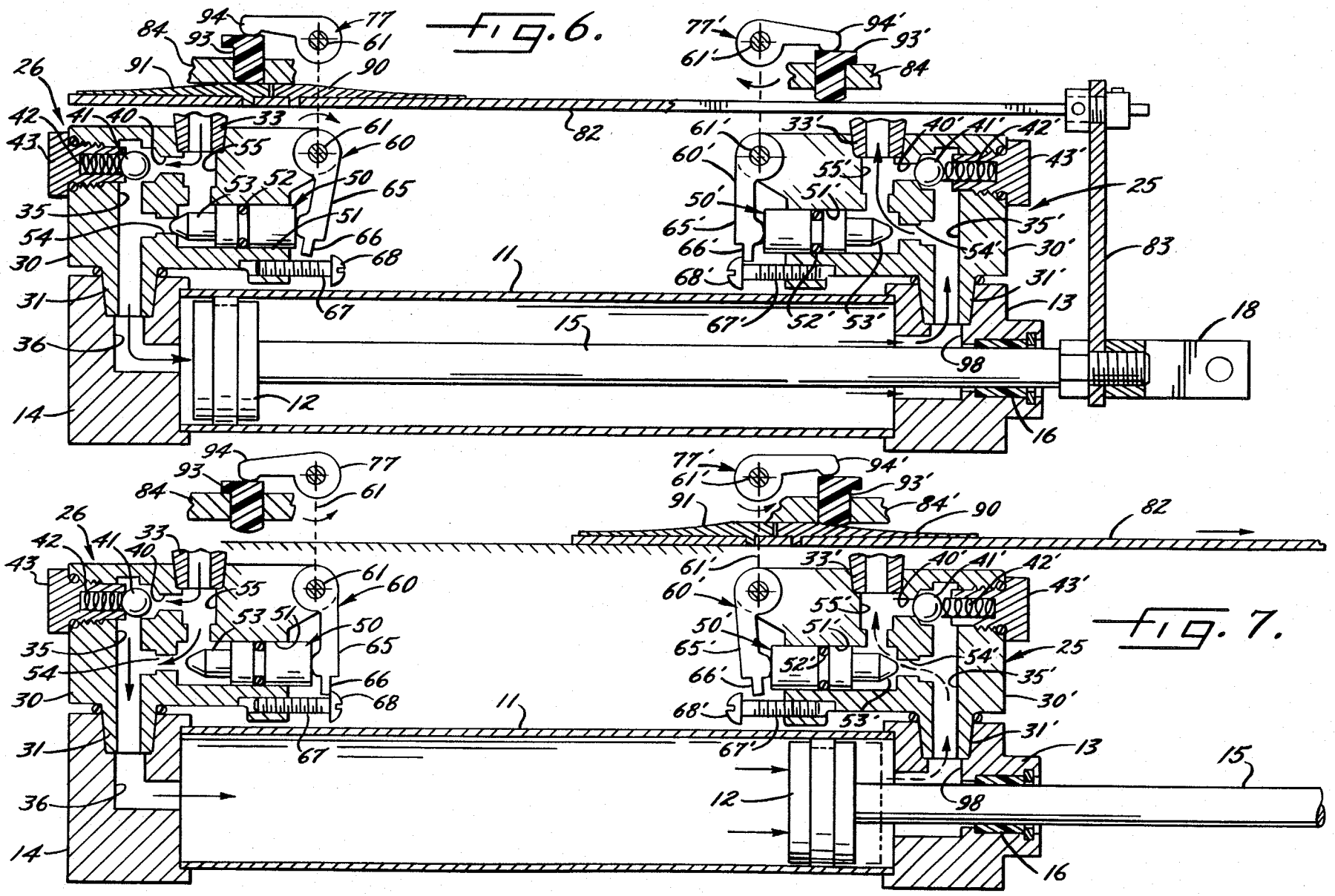
FIG. 6 is a cross-sectional view in somewhat schematic form taken longitudinally through the actuator illustrated in FIG. 1 and shows the piston of the actuator near one end of its stroke.
FIG. 7 is a view similar to FIG. 6 but shows the piston near the other end of its stroke.

Attached rigidly to the upper side of the rear end portion of the bar 82 are front and rear cam plates 90 and 91 (FIGS. 2 and 6). When the piston 12 is fully retracted as shown in FIG. 6, the rear cam plate 91 underlies a cam follower 93 which is mounted for up and down sliding in the guide tube 84. The follower is disposed immediately below a generally L-shaped arm 94 which forms part of the bellcrank 77. When the rear cam 91 moves beneath the follower 93 and pushes the follower upwardly, the follower engages the arm 94 and turns the rear bellcrank 77 clockwise so as to effect clockwise turning of the rear lever 60 and closing of the rear valve member 50.

The cams 90 and 91 are shaped in accordance with the deceleration characteristics desired for the piston 12. As shown in FIG. 6, the front cam 90 slopes downwardly as it progresses forwardly while the rear cam 91 slopes downwardly as it progresses rearwardly. In this particular instance, each cam surface is formed with slight concave curvature to impart a degree of nonlinearity to the deceleration characteristics of the piston. It will be appreciated, however, that each cam surface could be of constant slope so as to cause the piston to decelerate in a substantially linear manner.

As mentioned above, the front valve 25 is virtually identical to the rear valve 26. Accordingly, components of the front valve corresponding to those of the rear valve have been designated by the same but primed reference numerals. A second cam follower 93' (FIG. 6) adapted to coact with the front cam 90 is mounted for up and down sliding in the forward end portion of the guide tube 84 and underlies the arm 94' of the bellcrank 77' of the front valve 25.

To explain the operation of the actuator 10, let it be assumed that the piston 12 is in a fully retracted or nearly fully retracted position in the cylinder 11 as shown in FIG. 6. When the piston is so positioned, the high point of the rear cam 91 underlies the rear cam follower 93 and causes the latter to force the arm 94 of the bellcrank 77 in a clockwise direction. The screw 79 on the arm 78 of the bellcrank 77 acts against the pin 71 to force the lever 60 in a clockwise direction and cause the finger 66 of the lever to force the rear valve member 50 toward its closed position. At this time, the forward cam 90 is spaced well rearwardly of the forward cam follower 93' and thus the latter follower is located in a lowered position in the tube 84 as shown in FIG. 6. As a result, the bellcrank 77' may turn in a clockwise direction so as to free the lever 60' for clockwise turning. The front valve member 50' thus is permitted to open until the finger 66' of the lever 60' engages the head 67' of the screw 68' (see FIG. 6).

A cycle to advance the piston 12 forwardly is initiated when the main control valve 20 is shifted to a position pressurizing the line 23 via the line 21 and connecting the line 22 to atmosphere via the line 24. With the line 23 pressurized, pressurized air flows into the port 33 of the rear valve 26, pops the check valve 41 open, and flows into the rear end of the cylinder 11 via the passages 40, 35 and 36. As a result, the rear end of the cylinder 11 is pressurized to advance the piston 12 and the rod 15 forwardly. Pressure also is exerted against the valve member 50 to urge the latter outwardly.

As the piston 12 and the rod 15 begin advancing forwardly, the rear cam 91 moves forwardly from beneath the rear follower 93 so as to permit the rear bellcrank 77 and the rear lever 60 to swing counterclockwise to the position shown in FIG. 7. As a result, the pressure in the passages 54 and 55 opens the valve member 50 until the finger 66 of the lever 60 engages the head 67 of the screw 68.

During forward advancement of the piston 12 and the rod 15, air is exhausted out of the forward end of the cylinder 11 through a passage 98 (FIG. 6) in the front end cap 13 and through the lower end portion of the passage 35' of the front valve 25. As the air is exhausted, the branch passage 40' is closed by the check valve 41' (see FIG. 6) and thus the exhaust air is forced to flow through the branch passage 54', past the metering needle 53' of the valve member 50', and through the passage 55' to the exhaust port 33'. Accordingly, the rate of flow of the exhaust air, and hence the forward speed of the piston 12, is controlled by the limit position of the valve member 50'. By adjusting the screw 67' inwardly, the valve member 50' may be held at a more nearly closed limit position to more completely restrict the flow of exhaust air and cause the piston to advance at a relatively slow rate. Conversely, outward adjustment of the screw 67' enables the valve member to move to a more nearly open limit position to allow a greater flow of exhaust air and to effect an increase in the speed of the piston.

As the piston 12 nears the end of its forward stroke, the front cam 90 moves beneath the front cam follower 93' and gradually pushes that follower upwardly (see FIG. 7). As a result, the bellcrank 77' is rocked counterclockwise to cause the screw 79' to swing the lever 60' is counterclockwise. The arm 65' of the lever 60' thus acts against the valve member 50' to gradually move the latter inwardly and to cause the needle 53' to gradually restrict to a greater degree the flow of exhaust air through the branch passage 54'. Accordingly, the piston 12 is decelerated as it approaches the end cap 13 and therefore does not abruptly strike the end cap. Importantly, the cam 90 causes the deceleration itself to occur gradually and thus no abrupt shock is imparted to the actuator 10 when the piston starts decelerating. Hence, the piston comes to a relatively smooth stop.

A similar but reverse action takes place when the piston 12 is retracted in a rearward direction. That is, pressure opens the front valve member 50' to its limit position (FIG. 6) once the front cam 90 moves rearwardly from beneath the front follower 93'. As the piston 12 initially retracts, its speed is determined by the position of the rear valve member 50 as established by the setting of the screw 67. Then, as the piston approaches the end of its rearward stroke, the rear cam 91 moves beneath the rear follower 93 to rock the bellcrank 77 and the lever 60 clockwise. The rear valve member 50 thus is gradually shifted toward its closed position to gradually restrict the flow of air from the rear end of the cylinder 11 and to cause the piston to come to a gradual stop.

As mentioned above, the initial speed of the piston 12 in the forward and rearward directions may be adjusted by changing the settings of the screws 67' and 67, respectively. In addition, the points at which the piston starts decelerating during its forward and rearward strokes may be adjusted by changing the settings of the screws 79 and 79', respectively. For example, if the screw 79 is adjusted outwardly, the rear cam 91 must move rearwardly a greater distance and swing the bellcrank 77 through a greater angle before the screw 79 acts against the pin 71 to start closing the valve member 50. Conversely, inward adjustment of the screw 79 causes the screw to engage the pin 71 and start closing the valve member 50 after the bellcrank 77 has swung through a lesser angle by virtue of the rear cam 91 moving rearwardly through a lesser distance. Accordingly, it is a relatively simple matter to change the point at which the piston starts decelerating.

The leaf spring 75 protects the system in the event the screw 79 is inadvertently adjusted too far in an inward direction. Assume, for example, that the screw 79 is adjusted inwardly so far that, in the absence of the spring 75, the screw would cause the valve member 50 to reach its fully closed position before the cam 91 swung the bellcrank 77 clockwise through the full range of travel dictated by the cam. Without the leaf spring, a jam would occur and would result in damage to the system. By virtue of the spring 75, however, the pin 71 is allowed to slide inwardly to prevent such a jam. In addition, the spring serves as a means for preventing the valve member 50 from being tightly held in its fully closed position and completely cutting off the flow of exhaust air.

Figure 8:
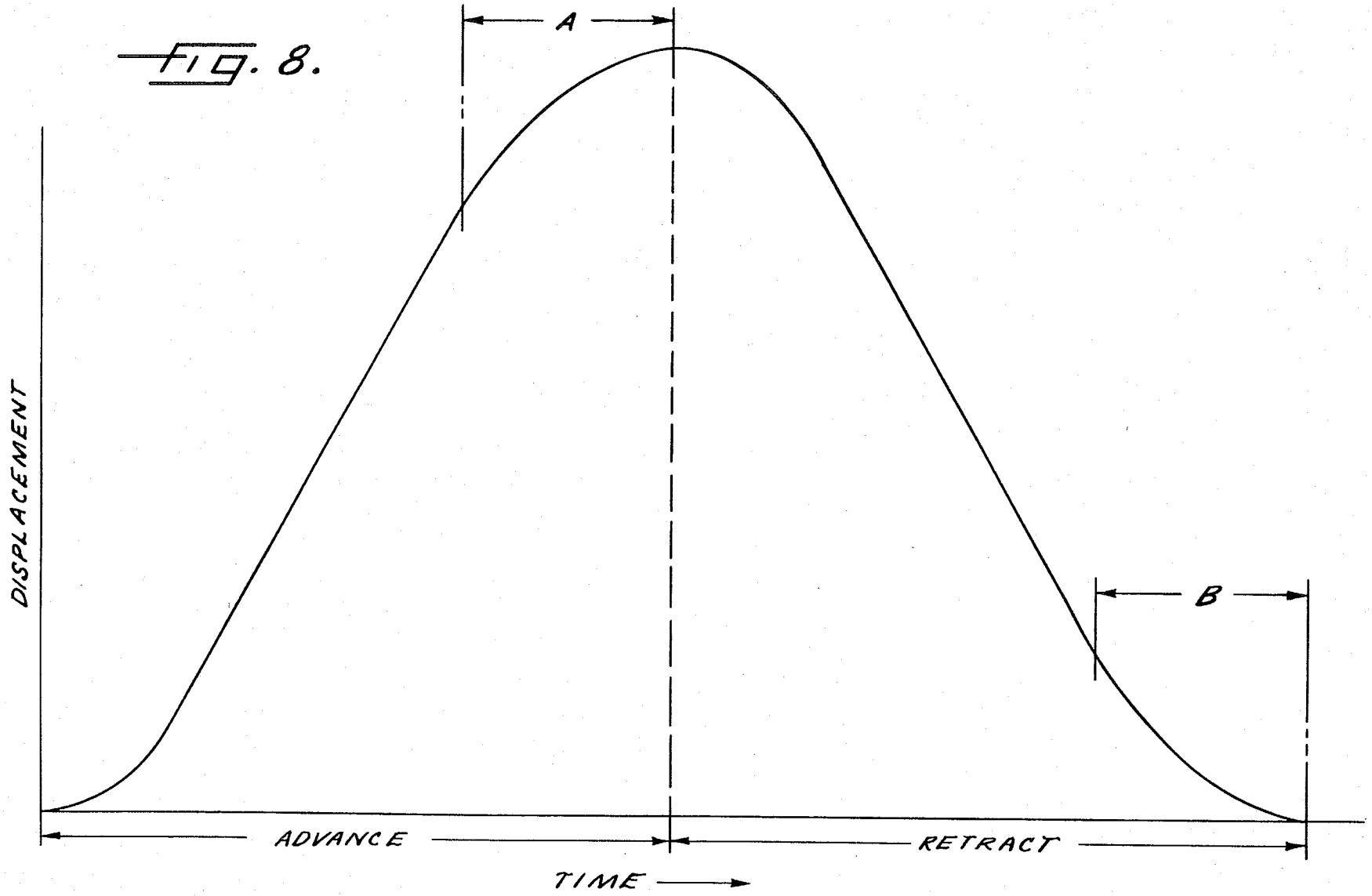
FIG. 8 is an approximate time/displacement curve for the piston.

FIG. 8 is an approximate time/displacement chart of the piston 12 during its advance and retract strokes, the left hand curve being representative of the advance stroke and the right hand curve being representative of the retract stroke. As indicated by the portion of the left hand curve labeled A, the piston smoothly decelerates as it approaches the end of its advance stroke and as the front cam 90 effects gradual closure of the front valve member 50'. Similarly, the piston smoothly decelerates as it approaches the end of its retract stroke, as indicated by the portion of the right hand curve labeled B, and as the rear cam 91 effects gradual closure of the rear valve member 50. By changing the shape of the cams, the deceleration characteristics of the piston may be modified to suit different applications. If, for example, the cam includes a flat sloping section located between two flat horizontal sections, the piston can be made to advance initially at a substantially constant rapid traverse rate and then at a slower and substantially constant feed rate.

I claim:

1. An actuator comprising an elongated cylinder member, a piston member telescoped into said cylinder member, one of said members moving in one direction relative to the other member when pressure fluid is exhausted out of one end of said cylinder member, a valve for controlling the flow of pressure fluid out of said one end of said cylinder member, said valve comprising a valve housing having a first port communicating with said one end of said cylinder member, said valve housing having a second port adapted to be alternately pressurized and de-pressurized to admit pressure fluid into and to exhaust pressure fluid from said housing, a primary flow passage in said valve housing and extending between said ports, means in said primary passage for permitting pressure fluid to flow from said second port into said one end of said cylinder through said primary passage while preventing pressure fluid from flowing reversely out of said one end of said cylinder to said second port through said primary passage, a secondary passage in said housing and extending between said ports, a valve member mounted in said housing, said valve member being movable toward a closed position to restrict the flow of pressure fluid through said secondary passage from said first port to said second port and being movable toward an open position to enable an increase in such flow, said valve member being exposed to the pressure fluid in said primary passage and being biased toward said open position by such pressure fluid, and means for moving said valve member toward said closed position at a controlled rate as an incident to said one member moving through a predetermined distance in said one direction whereby said valve member restricts the flow of pressure fluid out of said one end of said cylinder member and thereby restricts the rate of travel of said one member in said one direction, said moving means comprising a cam movable with said one member, a cam follower operably connected to said valve member and engageable with said cam when said one member moves through said predetermined distance in said one direction, a first lever pivotally mounted on said housing and having a pair of arms, said cam follower being operably associated with one of said arms, means on the other of said arms for moving said valve member toward said closed position in response to pivoting of said lever in one direction, a second lever pivotally mounted on said housing and free to turn in at least one direction independently of said first lever, said second lever being interposed between said valve member and said second arm of said first lever.

2. An actuator as defined in claim 1 in which said one member is said piston member and in which said other member is said cylinder member.

3. An actuator as defined in claim 1 in which said cam is a surface on one side of an elongated bar attached to and movable with said one member.

4. An actuator as defined in claim 3 in which said cam surface is inclined relative to the path of travel of said one member and is of varying slope.

5. An actuator comprising an elongated cylinder member, a piston member telescoped into said cylinder member, one of said members moving in one direction relative to the other member when pressure fluid is exhausted out of one end of said cylinder member, a valve for controlling the flow of pressure fluid out of said one end of said cylinder member, said valve comprising a valve housing having a first port communicating with said one end of said cylinder member and having a second port adapted to exhaust pressure fluid from said housing, a passage in said housing and extending between said ports, a valve member mounted in said housing, said valve member being movable toward a closed position to restrict the flow of pressure fluid through said passage from said first port to said second port and being movable toward an open position to enable an increase in such flow, and means for moving said valve member toward said closed position at a controlled rate as an incident to said one member moving through a predetermined distance in said one direction whereby said valve member restricts the flow of pressure fluid out of said one end of said cylinder member and thereby restricts the rate of travel of said one member in said one direction, said moving means comprising a cam movable with said one member, a cam follower operably connected to said valve member and engageable with said cam when said one member moves through said predetermined distance in said one direction, a first lever pivotally mounted on said housing and having a pair of arms, said cam follower being operably associated with one of said arms, means on the other of said arms for moving said valve member toward said closed position in response to pivoting of said lever in one direction, a second lever pivotally mounted on said housing and free to turn in at least one direction independently of said first lever, said second lever being interposed between said valve member and said second arm of said first lever.

6. An actuator as defined in claim 5 in which said means on said other arm comprises an adjustable member for turning said second lever in a direction to close said valve member.

7. An actuator as defined in claim 6 further including a second adjustable member on said valve housing for limiting swinging of said second lever in a direction permitting opening of said valve member.

* * * * *